US011713527B2

(12) United States Patent
Myers et al.

(10) Patent No.: US 11,713,527 B2
(45) Date of Patent: Aug. 1, 2023

(54) SYSTEMS AND METHODS FOR PACKAGING ARTICLES TO BE EMBROIDERED

(71) Applicant: CreateMe Technologies LLC, New York, NY (US)

(72) Inventors: Thomas C. K. Myers, San Francisco, CA (US); Khamvong Thammasouk, San Jose, CA (US); Jinhwa Jung, San Jose, CA (US); David Bennet Matten, Mountain View, CA (US); Benjamin R. Waller, IV, Oakland, CA (US); Lai Chyan Chow, San Francisco, CA (US)

(73) Assignee: CreateMe Technologies LLC, New York, NY (US)

( * ) Notice: Subject to any disclaimer, the term of this patent is extended or adjusted under 35 U.S.C. 154(b) by 0 days.

(21) Appl. No.: 17/549,507

(22) Filed: Dec. 13, 2021

(65) Prior Publication Data

US 2022/0307180 A1 Sep. 29, 2022

Related U.S. Application Data

(63) Continuation of application No. 17/093,579, filed on Nov. 9, 2020, now Pat. No. 11,198,963.

(51) Int. Cl.
*D05C 1/04* (2006.01)
*D05C 9/04* (2006.01)
(Continued)

(52) U.S. Cl.
CPC ..... *D05C 1/04* (2013.01); *B65D 25/005* (2013.01); *B65D 25/54* (2013.01); *B65D 85/70* (2013.01);
(Continued)

(58) Field of Classification Search
CPC ... D05C 1/00; D05C 1/02; D05C 1/04; D05C 9/04; D05C 9/00; D05C 9/02; D05C 3/08;
(Continued)

(56) References Cited

U.S. PATENT DOCUMENTS 1,200,052 A 10/1916 Trover
1,473,622 A * 11/1923 Gosch ..... D05C 1/04 112/121
(Continued)

FOREIGN PATENT DOCUMENTS

CN 109624517 4/2019
CN 110675557 1/2020
(Continued)

OTHER PUBLICATIONS

International Patent Application No. PCT/US2021/058439 , International Search Report and Written Opinion, dated Feb. 23, 2022, 15 pages.
(Continued)

*Primary Examiner* — Ismael Izaguirre

(57) ABSTRACT

Packaging is used to store articles to be customized by methods including embroidery, wherein the packaging includes at least two portions defining a window, and wherein the two portions of the packaging hold a portion of the article, for example a fabric panel, taut across the window so that the portion of the article may be embroidered by an embroidery machine while retained by portions of the packaging. The packaging may be in the form of a box during embroidery, or may be converted into the form of a box after embroidery.

20 Claims, 13 Drawing Sheets

(51) Int. Cl.

| | |
|---|---|
| ***B65D 25/54*** | (2006.01) |
| ***D05B 39/00*** | (2006.01) |
| ***B65D 85/00*** | (2006.01) |
| ***B65D 25/00*** | (2006.01) |
| *B65D 85/18* | (2006.01) |

(52) U.S. Cl.
CPC ..... *D05B 39/00* (2013.01); *D05C 9/04* (2013.01); *B65D 85/182* (2013.01)

(58) Field of Classification Search
CPC ..... B65D 25/005; B65D 25/54; B65D 85/70; B65D 85/182; D05B 39/00; D05B 21/00
See application file for complete search history.

(56) References Cited

U.S. PATENT DOCUMENTS

| | | | | |
|---|---|---|---|---|
| 3,621,991 | A | 11/1971 | Richter | |
| 4,071,139 | A | 1/1978 | Pernicano | |
| 4,277,901 | A | 7/1981 | Williams | |
| 4,998,964 | A | 3/1991 | Golia | |
| 5,138,960 | A * | 8/1992 | Inteso | D05C 9/04 112/103 |
| 5,144,899 | A * | 9/1992 | Allen | D06P 5/001 428/906.6 |
| 5,433,158 | A | 7/1995 | Moore, III | |
| 5,540,636 | A | 7/1996 | Hellen | |
| 5,970,895 | A * | 10/1999 | Mack | D05C 9/04 38/102.2 |
| 5,988,085 | A | 11/1999 | Maertz | |
| 6,493,968 | B2 * | 12/2002 | Chinitz | B44D 3/185 38/102.91 |
| 7,100,523 | B2 | 9/2006 | Terao | |
| 7,194,967 | B2 * | 3/2007 | Bowlus | D05C 9/04 38/102.2 |
| 7,357,088 | B1 * | 4/2008 | Bowlus | D05C 9/04 112/103 |
| 7,458,174 | B1 | 12/2008 | Gustin et al. | |
| 8,112,858 | B2 | 2/2012 | Robles | |
| 8,844,452 | B2 * | 9/2014 | Savoldi | D05B 21/007 112/103 |
| 8,947,912 | B2 | 2/2015 | Calhoun et al. | |
| 8,989,893 | B2 | 3/2015 | Jones et al. | |
| 9,296,552 | B2 | 3/2016 | Schleuning et al. | |
| 9,609,963 | B1 | 4/2017 | Ratnow | |
| 10,189,278 | B1 | 1/2019 | Friedrich et al. | |
| 10,532,591 | B2 | 1/2020 | Ueno et al. | |
| 10,550,514 | B2 | 2/2020 | Matsumoto | |
| 11,161,353 | B1 | 11/2021 | Thammasouk et al. | |
| 11,198,963 | B1 * | 12/2021 | Thammasouk | B65D 25/005 |
| 11,254,154 | B1 | 2/2022 | Thammasouk | |
| 2001/0055123 | A1 | 12/2001 | Ryan et al. | |
| 2002/0013745 | A1 | 1/2002 | Funahashi et al. | |
| 2002/0038621 | A1 * | 4/2002 | Ozeki | D05C 9/04 112/103 |
| 2002/0092222 | A1 * | 7/2002 | Ong | G11B 33/0483 |
| 2003/0209181 | A1 * | 11/2003 | Shibata | D05C 9/04 112/470.14 |
| 2003/0209182 | A1 | 11/2003 | Shibata | |
| 2004/0172325 | A1 | 9/2004 | Blanco et al. | |
| 2006/0196883 | A1 | 9/2006 | Ward | |
| 2007/0024909 | A1 | 2/2007 | Hanechak | |
| 2008/0093257 | A1 * | 4/2008 | Kim | B65D 51/18 206/769 |
| 2008/0249658 | A1 | 10/2008 | Walker et al. | |
| 2008/0276849 | A1 * | 11/2008 | Mack | D05C 9/04 112/103 |
| 2010/0300309 | A1 | 12/2010 | Schneider | |
| 2013/0036018 | A1 | 2/2013 | Dickerson | |
| 2013/0138243 | A1 | 5/2013 | Freeman | |
| 2014/0225978 | A1 | 8/2014 | Saban et al. | |
| 2014/0278918 | A1 | 9/2014 | Moran | |
| 2015/0330018 | A1 | 11/2015 | Zornow | |
| 2017/0320316 | A1 | 11/2017 | Nakamura | |
| 2018/0105979 | A1 | 4/2018 | Matsumoto | |
| 2019/0093268 | A1 | 3/2019 | Takeuchi et al. | |
| 2019/0168500 | A1 | 6/2019 | Martinez | |
| 2022/0143994 | A1 | 5/2022 | Chow et al. | |
| 2022/0228315 | A1 | 7/2022 | Arens et al. | |
| 2022/0241983 | A1 | 8/2022 | Baker | |

FOREIGN PATENT DOCUMENTS

| | | | | |
|---|---|---|---|---|
| CN | 111204121 | | 5/2020 | |
| CN | 111962275 | A | 11/2020 | |
| CN | 112529113 | | 3/2021 | |
| DE | 102017104808 | A1 | 2/2018 | |
| EP | 2775022 | A1 * | 9/2014 | D05B 11/00 |
| JP | 2003041420 | A | 2/2003 | |
| JP | 3609120 | B2 | 1/2005 | |
| JP | 3669633 | | 4/2005 | |
| JP | 2016197273 | A | 11/2016 | |
| KR | 200368636 | Y1 | 11/2004 | |
| WO | 2004044671 | | 5/2004 | |
| WO | 2020227311 | | 11/2020 | |
| WO | 2020227311 | A1 | 11/2020 | |

OTHER PUBLICATIONS

International Patent Application No. PCT/US2021/058452 , International Search Report and Written Opinion, dated Feb. 8, 2022, 11 pages.

U.S. Appl. No. 17/093,579, Non-Final Office Action, dated Apr. 1, 2021, 8 pages.

Precise 2021, PFDD Direct Drive Robot—The Next Generation of Collaborative Robots,retrieved Aug. 20, 2021, 2 Pages «http://preciseautomation.com/PFDD.html«.

N. Lobo, "Inlelli-Mirror: An Augmented Reality based IoT System for Clothing and Accessory Display", 2016 International Conference on Internet of Things and Applications, Jan. 2016, pp. 95-100 (Year: 2016)

Feng, et al. "A Review of An Interactive Augmented Reality Customization Clothing System Using Finger Tracking Techniques as Input Device", Computational Science and Technology, Lecture Notes in Electrical Engineering 603, 2020, pp. 457-467 (Year: 2020).

Shaw, et al. "Advanced Virtual Apparel Try Using Augmented Reality (AVATAR)", Soft Computing: Theories and Applications, Advances in Intelligent Systems and Computing 1154, 2020, pp. 479-487 (Year: 2020).

Dong, MachineTranslationofCN-111962275-A, 2020 (Year: 2020).
MachineTranslationfKR-200368636-Y1, 2003 (Year: 2003).

* cited by examiner

SYSTEMS AND METHODS FOR PACKAGING ARTICLES TO BE EMBROIDERED

CROSS-REFERENCES TO RELATED APPLICATIONS

This application is a continuation of U.S. patent application Ser. No. 17/093,579, filed Nov. 9, 2020, which is hereby incorporated herein by reference.

FIELD OF INVENTION

The present technology relates to the field of embroidered articles, for example clothing items, and more particularly to systems and methods for packaging and preparing articles to be embroidered.

BACKGROUND OF THE INVENTION

Embroidery is the decorative technique on articles, for example textile materials or finished garments, using a needle to apply a thread onto the surface of the article. The process may be used to decorate articles, such as caps, tee-shirts, dress shirts, uniforms, athletic apparel, shoes, handbags, home furnishings, and related novelty items. In existing embroidery technology, articles to be embroidered are typically stored awaiting to be embroidered in a stacked or folded manner. The articles may be non-rigid, for example articles of clothing comprising fabric. In order to load the articles onto an embroidery machine, the non-rigid articles may be affixed to a two part embroidery hoop, the process of affixing an article to the hoop may be performed manually.

In on-demand embroidery settings, for example at a mall kiosk, the step of affixing the embroidery hoop to the article is labor intensive, and involves both time and skill in orienting and aligning the hoop so that the embroidered design is properly placed onto the article by an embroidery machine. Accordingly, there is a need to eliminate the need to affix an embroidery hoop to an article to be embroidered at the location of embroidery.

SUMMARY OF THE INVENTION

The present technology relates to packaging articles to be customized by methods including embroidery, wherein the packaging includes at least two portions defining a window, wherein the two portions of the packaging hold a portion of the article, for example a fabric panel, taut across the window so that the portion of the article may be embroidered by an embroidery machine while retained by portions of the packaging. The packaging may be in the form of a box during embroidery, or may be converted into the form of a box after embroidery.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION OF THE INVENTION

Figure 1A:
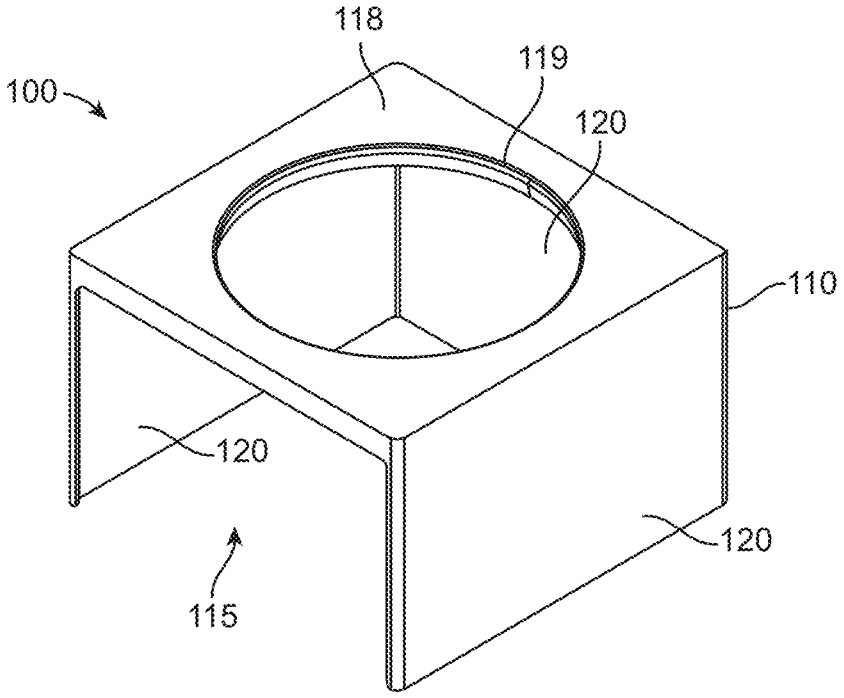
FIGS. 1A-1H show packaging according to embodiments of the present technology.

Throughout this description, for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

The present technology relates to packaging or portions thereof, include, but not limited to combinations of one or more of: boxes, enclosures, scaffolding, constructs, molds, assemblies, framings and/or other types of casings to store and allow manipulation of articles to be embroidered, wherein the packaging defines an external window and a corresponding internal window for holding a portion of the article, for example a fabric panel, taut across the windows so that the portion of the article may be embroidered by an embroidery machine while retained by the packaging. The packaging may be configurable into various configurations, for example a storage configuration, an embroidering configuration, and a retail configuration. While embodiments disclosed herein use embroidery as an example of a customization of an article, the present technology may be use with other customization processes including but not limited to: Direct to Garment (DTG) printing, dye sublimation, heat transfer printing processes, acid washing, and laser etching.

The packaging, or a portion thereof, and attached article, or articles, may be stored prior to being embroidered, and the packaging may be placed in a storage configuration. In the storage configuration, the packaging may be configured so that it may be at least one of: stackable, reduced in height, and/or reduced in size relative to other configurations. The packaging in the storage configuration may be generally flat so that the combination of the packaging and article may be stacked, for example for storage and transport. In the storage configuration, in some embodiments, the packaging may be in a flattened configuration wherein the packaging may be transitioned from the flattened configuration, e.g. a collapsed and/or unfolded configuration, to an un-flattened configuration, e.g. an un-collapsed and/or folded up configuration, so that the packaging occupies less volume in the storage configuration than in the embroidering and/or retail configurations. In some embodiments, the portions of the packaging may be nested to occupy less volume, for example in the storage configuration, and may be un-nested in other configurations, for example the embroidering configuration. In the embroidering configuration the packaging may include features that are accessible to a robot in order for the robot to automatically move the packaging and retained article, for example but not limited to, from a storage location to an embroidery machine.

In order to embroider the article, the portion of the article to be embroidered may have to be accessible from both sides. In the embroidering configuration the packaging may be held by an embroidery machine so that both sides of the portion of the article are accessible. In some embodiments, in the embroidering configuration the packaging includes an embroidering access opening providing access to an interior of the packaging in order to receive an arm, also referred to as a cylinder bed, of an embroidery machine so that the portion of the article held taut across the window may be accessed from the interior side by the arm of the embroidery machine inside the interior of the packaging. In the embroidering configuration, in some embodiments, the packaging may be in the same configuration as the storage configuration. In the embroidering configuration, in some embodiments, the packaging may be in a different configuration than the storage configuration, for example the packaging may be collapsed in the storage configuration, and uncollapsed in the embroidering configuration.

After the article is embroidered, the packaging may be configured into a retail configuration. In the retail configuration, the packaging may be configured into a box, for example by folding up portions of the packaging, closing portions of the packaging, removing portions of the packaging, and/or adding additional packaging portions to the packaging. Transitioning from one configuration to another may be accomplished with pre-configured folding lines in the packaging, and may be performed automatically, for example with a robot.

In some embodiments, the packaging may be in the form of a box in at least one of the storage, embroidering or retail configurations, for example a rectangular prism shaped container. The packaging may comprise one or more of an internal box portion, a top box portion, and a bottom box portion. In embodiments, the top box portion, bottom box portions, and the internal box portion may be formed of one or more of: metal, paper, cardboard, plastic, rubbers, glass, wood, and composites. One or more of the portions of the packaging may include a window. FIG. 1A shows an example of an internal box portion 110 of a packaging 100. As shown, the internal box portion 100 includes a top side 118 defining an internal window 119. The internal window 119 may engage another component, for example a component of the packaging 100, in order to clamp the article 106 (see FIG. 2A) to be embroidered between the internal window 119 and a window of the other component. In some embodiments, an article may be embroidered by positioning the internal box portion 110 inside of the article, so that the portion to be embroidered is positioned over the internal window 119. A component including a window flange may be coupled to the internal box portion in order to clamp the article between the internal box portion and the component, so that the portion of the article to be embroidered is held taut across the window.

Figure 1B:
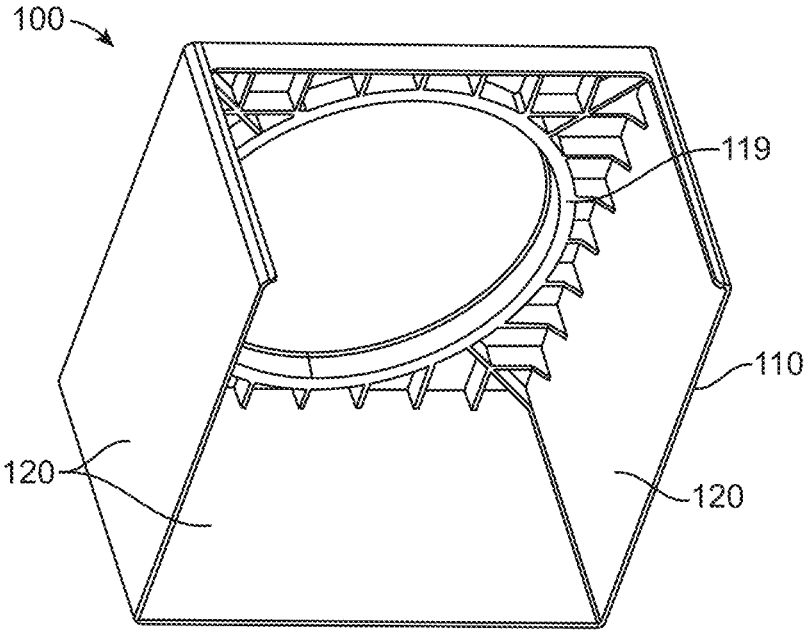

As shown the internal window 119 is circular, however in other embodiments, the internal window may be other shapes. The internal box portion 110 may include a plurality of sidewalls 120 extending from the top side 118 of the internal box portion 110 in order to define a box with an internal cavity. For example, as shown in FIGS. 1A and 1B the internal box portion comprises three sidewalls 120. As shown in FIG. 1A, an embroidery access opening 115 is defined by the open side of the internal box portion 110 wherein at least a portion of a sidewall 120 is not present.

Figure 1D:
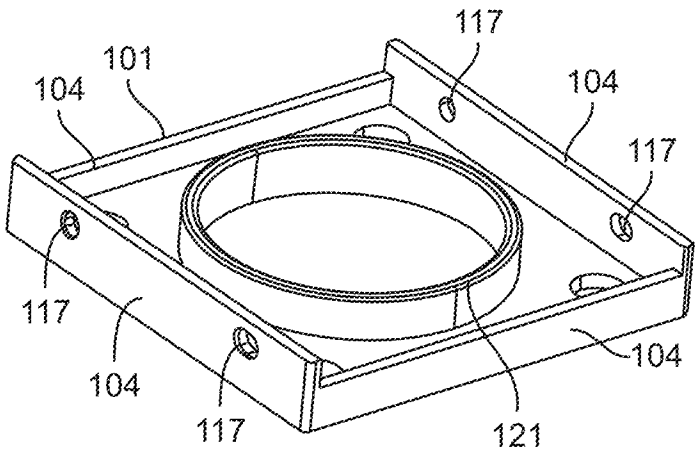
Figure 1C:
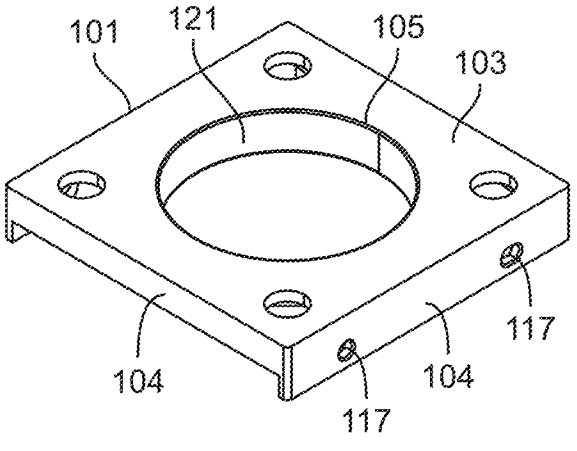
Figure 1F:
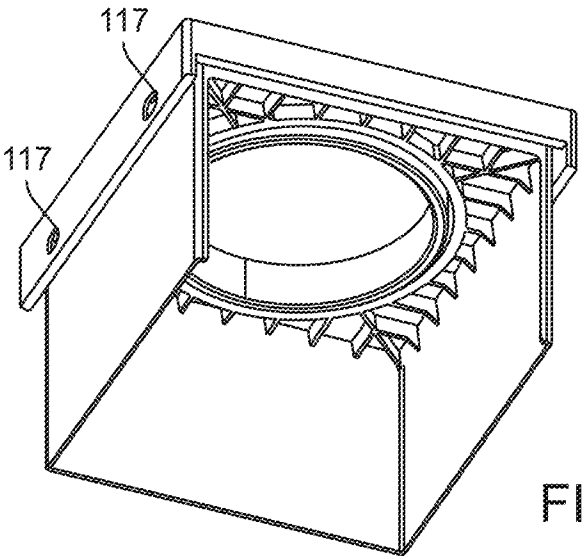

The packaging may further include a top box portion, which may be coupled to the internal box portion. For example, as shown in FIGS. 1C and 1D, the packaging 100 may further include a top box portion 101. The top box portion 101 of packaging 100 comprises a top side 103. The top side 103 defines a window 105. Surrounding the window 105 is a window flange 121. The top box portion 101 may further comprise a plurality of sidewalls 104 extending in the same direction as the window flange 121 from the top side 103. The sidewalls 104 may include features, for example but not limited to recesses 117, to receive portions of a robot gripper so that the top box portion 101, and any components or articles coupled thereto may be moved by a robot. The top box portion 101 including the top side 103 and sidewalls 104 are shaped and sized to nest over the internal box portion 110.

Figure 1E:
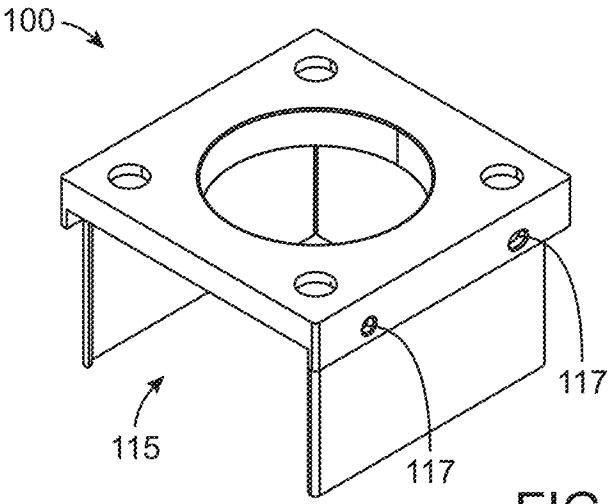

In order for a portion of an embroidery machine to access the portion of the article to be embroidered, packaging, as disclosed herein, may include an embroidery access opening. For example, as shown in FIG. 1E, the internal box portion 110 of packaging 100 may include an embroidering access opening 115 in order to provide access to the interior of the packaging by an embroidery machine so that the internal surface of the portion of the article to be embroidered held across window 119 may be accessed. For example, in a configuration of the packaging including at least the internal box portion 110, for example as shown in FIG. 1A, the embroidery access opening 115 is defined by the open side of the internal box portion 110 wherein at least a portion of a sidewall 120 is not present. In a configuration including the internal box portion 110 coupled to the top box portion 101, for example as shown in FIG. 1E, an article may be clamped between the two portions with the embroidery access opening 115 defined by open sides of the internal box portion and/or the top box portion, wherein at least a portion of one of the sidewalls 120 and/or 104 is not present.

Figure 1G:
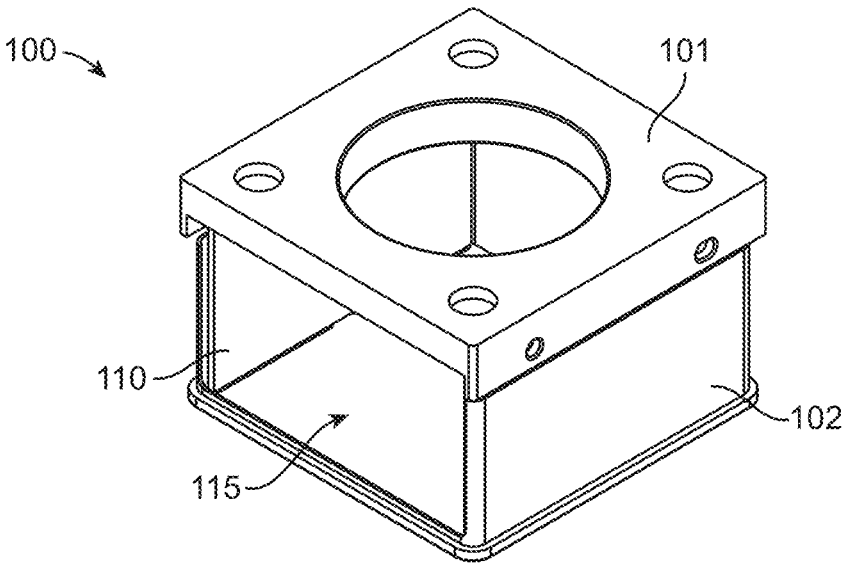
Figure 1H:
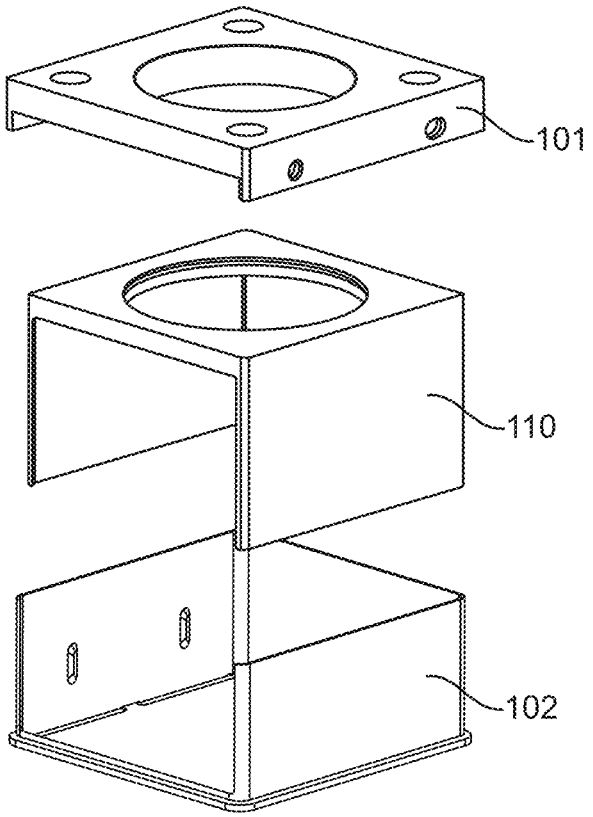

In some embodiments, packaging as disclosed herein may include a bottom box portion coupled to one or more of the top box portion and/or the internal box portion. For example, as shown in FIGS. 1G and 1H, packaging 100 may include a bottom box portion 102. The bottom box portion 102 may be coupled to the internal box portion 110. As shown, the top box portion 101, the internal box portion 110 and the bottom box portion 102 are coupled together so that an embroidery access opening 115 is defined on one side of the packaging.

In some embodiments, packaging as disclosed herein may be used to embroider an article with the bottom box portion coupled to the internal box portion, and in some embodiments, packaging as disclosed herein may be used to embroider an article without the bottom box portion coupled to the internal box portion. The bottom box portion may be coupled to the internal box portion before, during, and/or after embroidering the article.

In embodiments, the embroidery access opening may be formed on any side of the packaging. For example, a sidewall of the top box portion 101, a sidewall of the internal box portion 110 and/or a sidewall of the bottom box portion 102 may define an embroidering access opening 115. In some embodiments, packaging may include columns or other structures providing mechanical strength to the packaging instead of one or more of the sidewalls, which may provide the advantage of reducing the amount of material used to form the packaging and to provide additional openings or access to the interior of the packaging.

As shown in FIGS. 1A-1H, the internal box portion 110 may have a greater depth than the top box portion 101, so that with the portions coupled together the sidewalls 120 extend beyond the sidewalls 107. In some embodiments, the internal box portion 110 may have a depth less than a depth of the top box portion, for example as shown in FIGS. 2A and 2B.

Figure 2A:
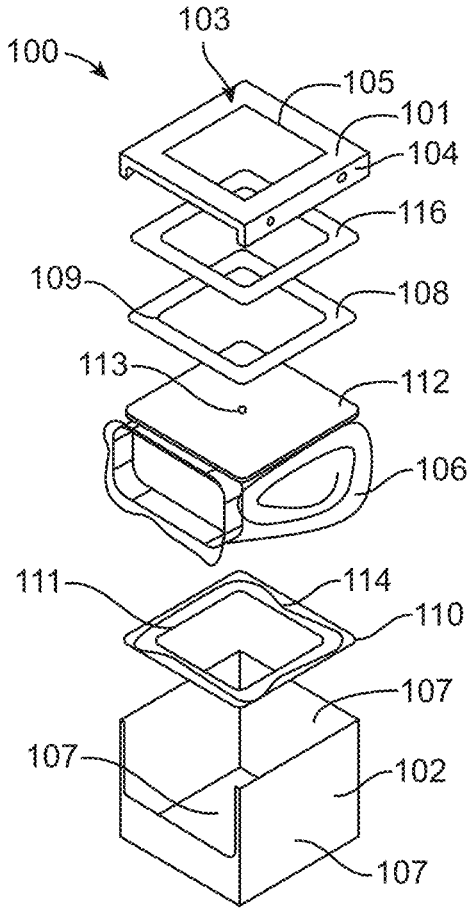
FIGS. 2A-2I show packaging according to embodiments of the present technology.
Figure 2B:
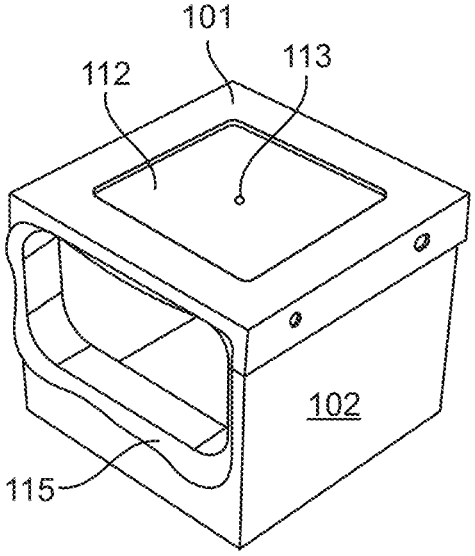
Figure 2C:
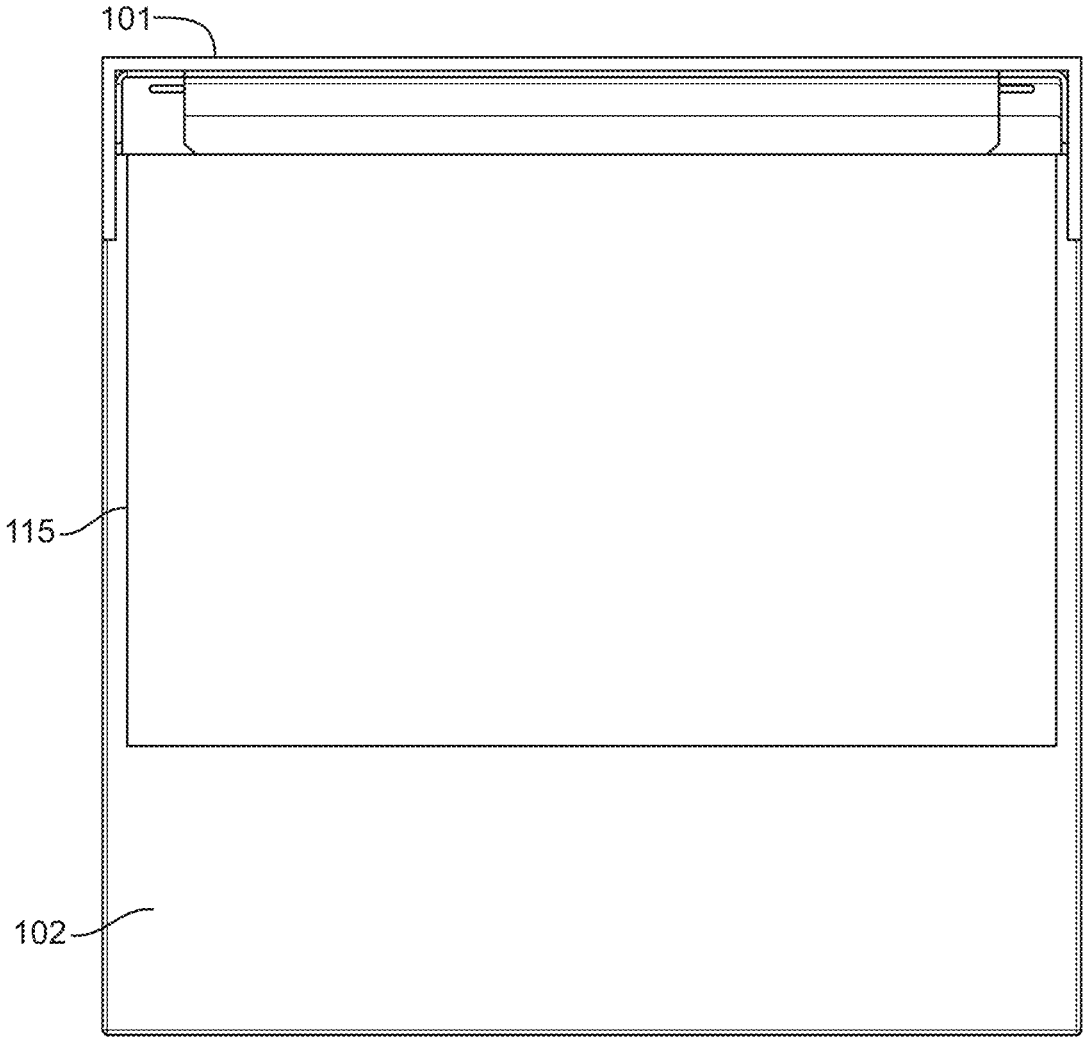
Figure 2D:
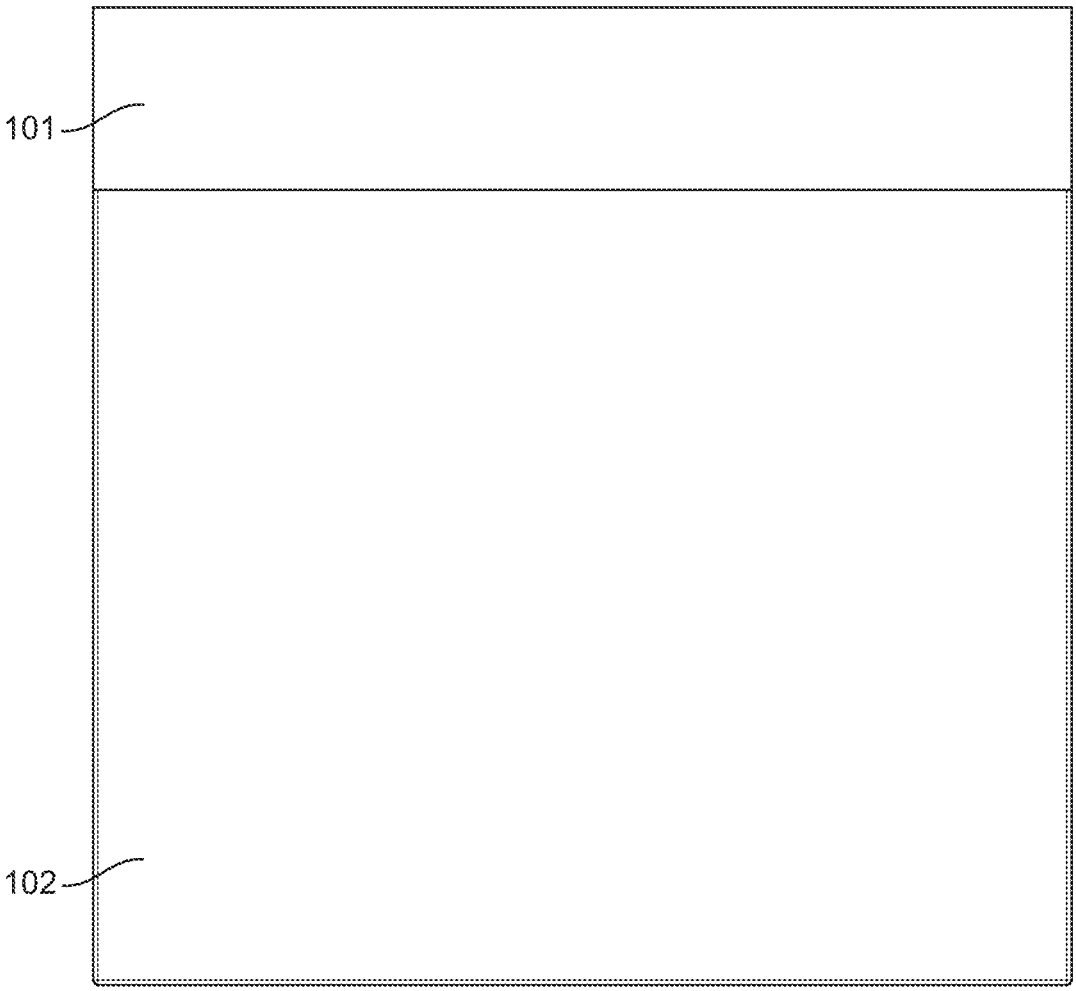
Figure 2E:
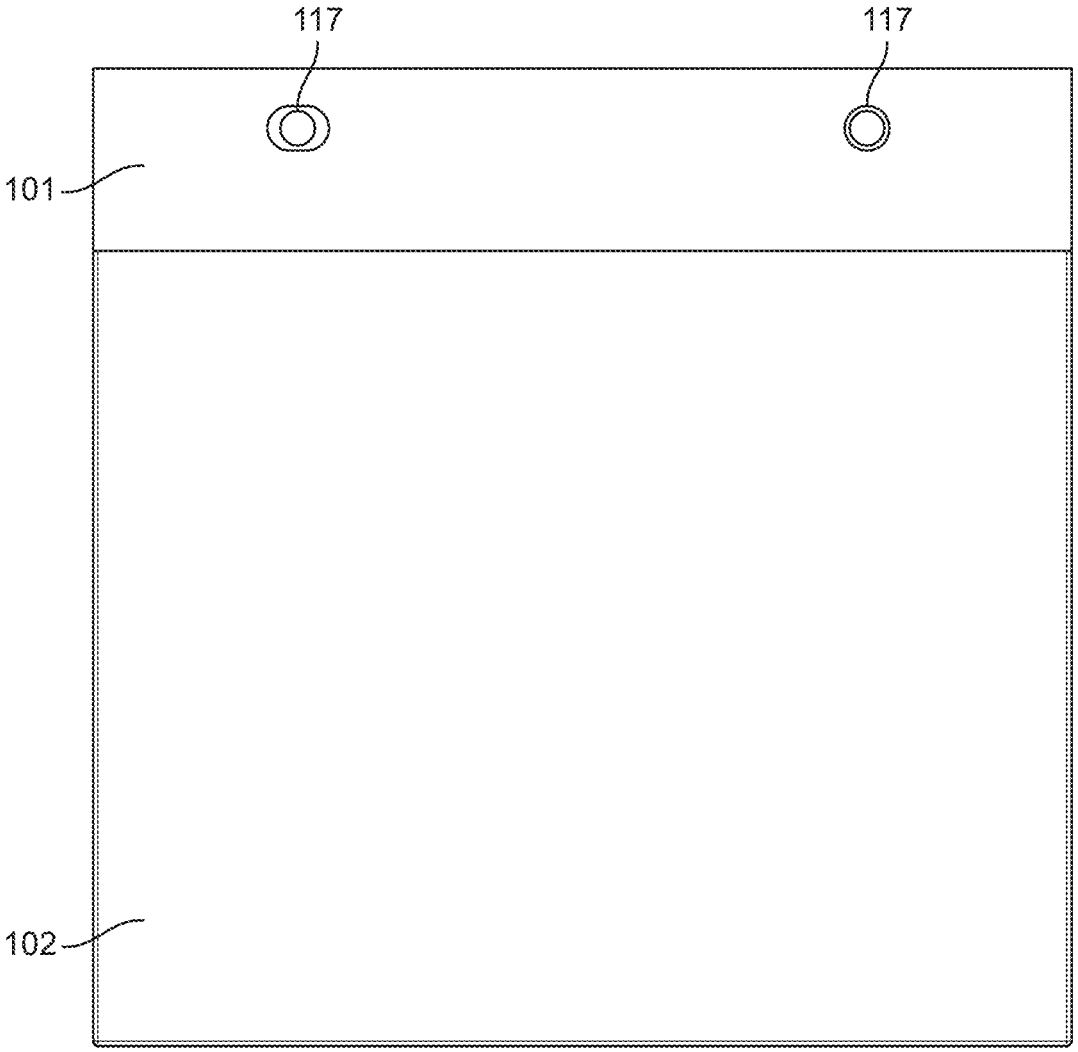
Figure 2F:
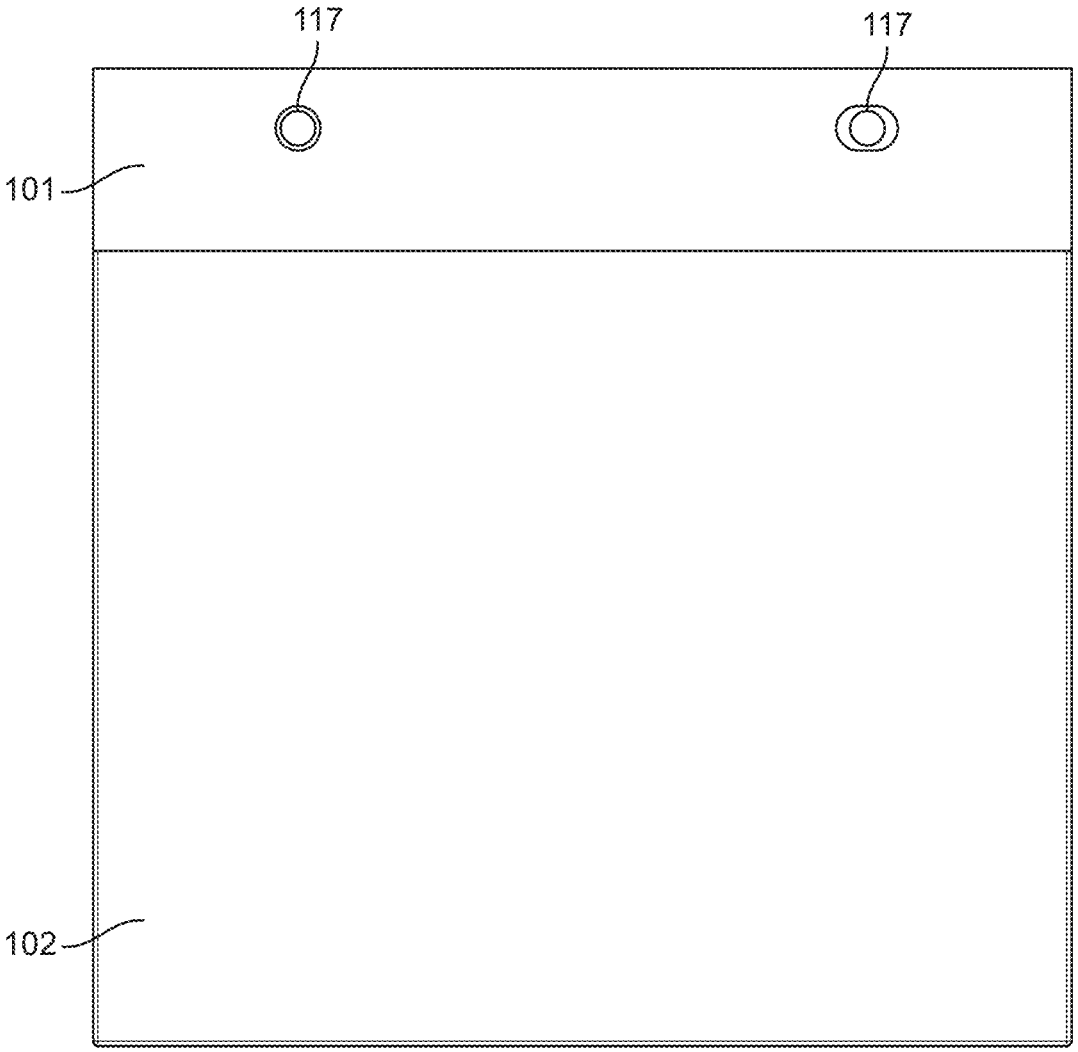
Figure 2G:
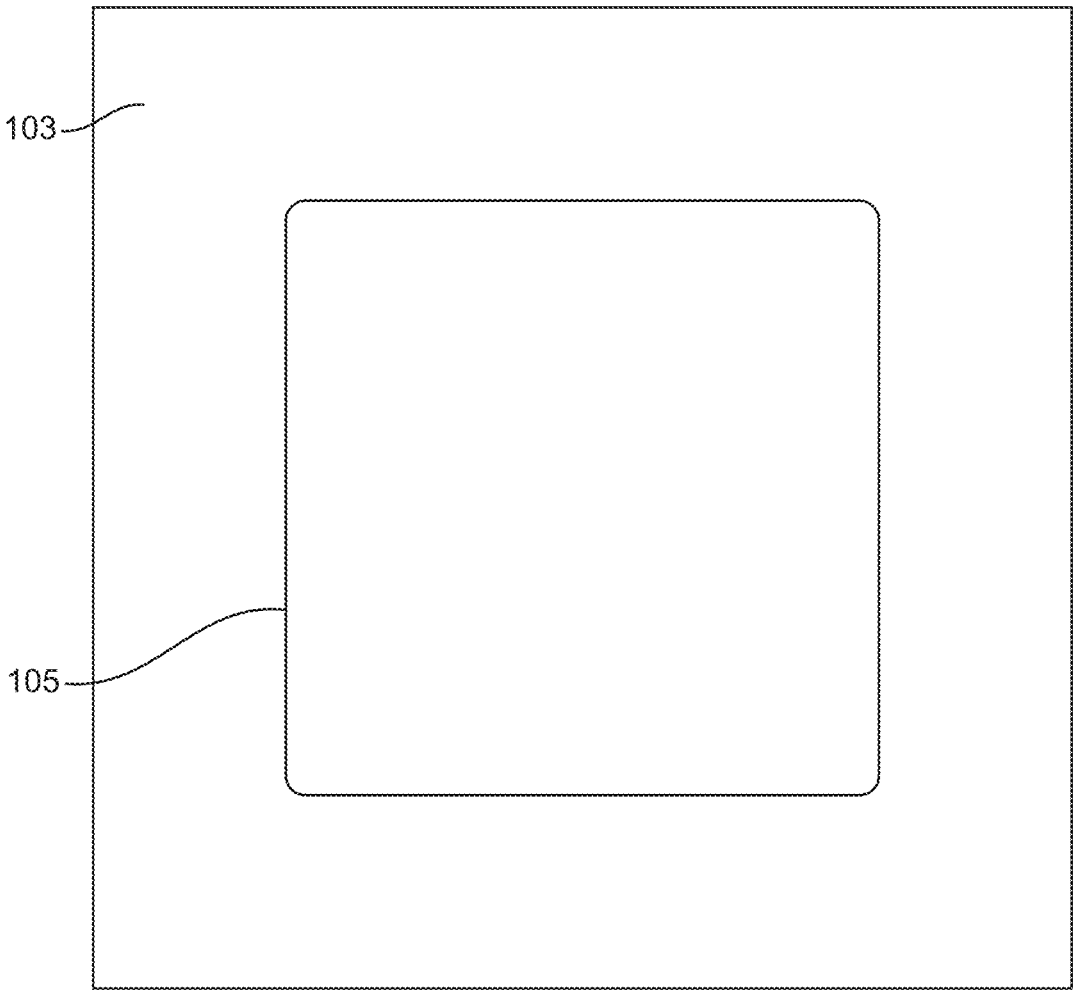
Figure 2H:
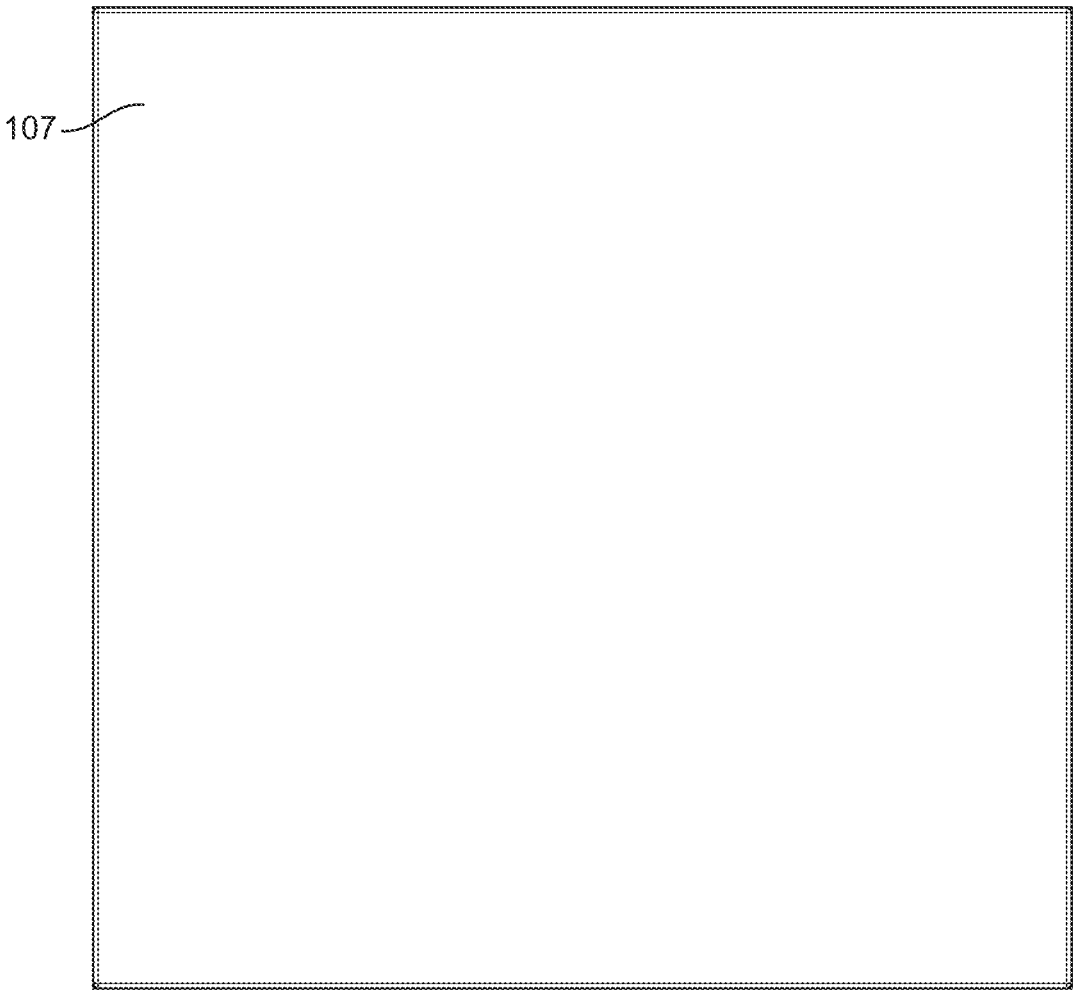

As shown in FIGS. 2A and 2B, a packaging 100 may include a top box portion 101 coupled to a bottom box portion 102, and an internal box portion 110 coupled to the top box portion 101 and positioned within an internal cavity defined between the top box portion 101 and the bottom box portion 102. FIGS. 2C-2H, show front, rear, left side, right side, top side, and bottom side views, respectively, of the packaging shown in FIG. 2B. As shown in FIG. 2A, the top box portion comprises a top side 103 and a plurality of sidewall portions 104. The top side 103 defines a window 105, as discussed above. In embodiments, for example as shown in FIGS. 2A and 2B, the window 105 is square, however in other embodiments the window 105 may be other shapes. Examples of window shapes include, but are not limited to, rectangular, circular, elliptical, polygonal, or star shaped. The window 105 provides access to an article 106 retained in the packaging 100 to be embroidered, and may also provide a visual indication of the actual contents of the packaging. For example, the window 105 may allow an employee or customer of a store, or a camera equipped with artificial intelligence based vision, to manually or automatically select a color, material, style, and/or design of clothing to be embroidered without opening the packaging.

The bottom box portion 102 comprises a plurality of sides 108 comprising a bottom side and a plurality of sidewall portions. As shown in FIG. 2B, the bottom box portion 102 may nest within the top box portion 101 so that the sidewalls of the top box portions 101 are outside of the sidewalls of the bottom box portion 102 to define the box. In some embodiments, the top box portion 101 may nest within the sidewalls of the bottom box portion 112 to define the box. In some embodiments, the box or other assembly may be formed by various components of a scaffolding, construct, mold, assembly and/or other types of casing to provide a partially open structure with multiple article display windows.

Packaging as disclosed herein may be substantially cube shaped, for example as shown in FIGS. 1G and 2B. However, in embodiments other shapes are envisioned for example rectangular prism, polygonal prisms, cylinders, or any shaped top and bottom surfaces with corresponding sidewalls.

The packaging 100, for example as shown in FIGS. 2A and 2B, may include internal portions including features for securing a portion of the article within the window 105, for example, but not limited to, clamping due to friction and other mechanical forces and/or a magnetic forces. As shown in FIG. 2A, the top box portion 101 may include a first support bracket 108 affixed to or integrally formed with the top side 103. For example, the first support bracket may be affixed to the top box portion with double sided tape 116 or adhesive onto an interior surface of the top side 103. As shown, the outline of the first support bracket 108 may substantially correspond to the shape and size of the outline of the top side 103. The first support bracket 108 may define a bracket window 109 corresponding in shape and size to the window 105 of the top side 103. For example, as shown, the first support bracket 108 is square shaped with a square shaped bracket window 109. The first support bracket 108 is coupled to or integrally formed with the top side 103 so that the window 105 and the bracket window 109 align. In embodiments, the first support bracket 108 is comprised partially or entirely of a metallic material. The metallic material may be magnetic, diamagnetic, ferromagnetic or paramagnetic.

The packaging may further comprise an internal portion. For example as shown in FIG. 2A, the packaging 100 includes an internal box portion in the form of a second support bracket 110. In embodiments, for example as shown in FIG. 2A, the second support bracket defines a depth less than the depth of the top box portion. In the assembled state, the internal box portion is within an interior cavity defined by the top box portion and the bottom box portion. The second support bracket 110 may be substantially the same shape and size as the first support bracket 108 and/or the top side 103. For example, as shown in FIG. 2A, the second support bracket 110 is square shaped with a square shaped bracket window 111. In some embodiments, the first support bracket 108 and the second support bracket 110 may be configured to be magnetically attracted to each other. For example, the first support bracket 108 may be ferromagnetic, and the second support bracket 110 may be comprised partially or entirely of material that is permanently magnetized.

To package an article 106, for example a t-shirt, within packaging 100, for example as shown in FIGS. 2A and 2B, the article 106 may be placed against the first support bracket 108 with a portion 112 of the article 106 to be embroidered positioned and aligned within the window 105. The second support bracket 110 may be magnetically coupled to the first support bracket 108 in order to sandwich the portion 112 of the article 106 between the support brackets and keep the portion 112 taut within the window 105. In other embodiments, the top box portion 101 and the internal box portion 110 may frictionally engage, for example with a press fit in order to hold the portion 112 of the article in the window 105. The article 106 may include an alignment mark(s) 113, as shown, used for positioning and/or orienting the article 106 within the window 105 of any of the packaging disclosed herein. In the configuration shown in FIGS. 2A and 2B, the surfaces of the support brackets 108 and 110 retaining the article 106 may be substantially parallel to the taut portion 112 to be embroidered, or may include complementary sloped conical like surfaces. In embodiments, embroidering using packaging as disclosed herein may include stabilizer material 114 positioned between the surfaces holding the article 106. The stabilizer material 114 provides a backing to improve the appearance and durability of the embroidered design.

With the portion 112 of the article 106 to be embroidered held taut between the support brackets 108 and 110, the remaining portions of the article 106 may be folded and placed in the bottom box portion 102 and the top box portion 101 may then be nested over the bottom box portion 102 to enclose the article 106. The folded article may be positioned within the packaging 100 so that an arm of an embroidery machine can be positioned into the interior cavity of the box and access the interior surface of the portion of the article retained between the support brackets.

Figure 2I:
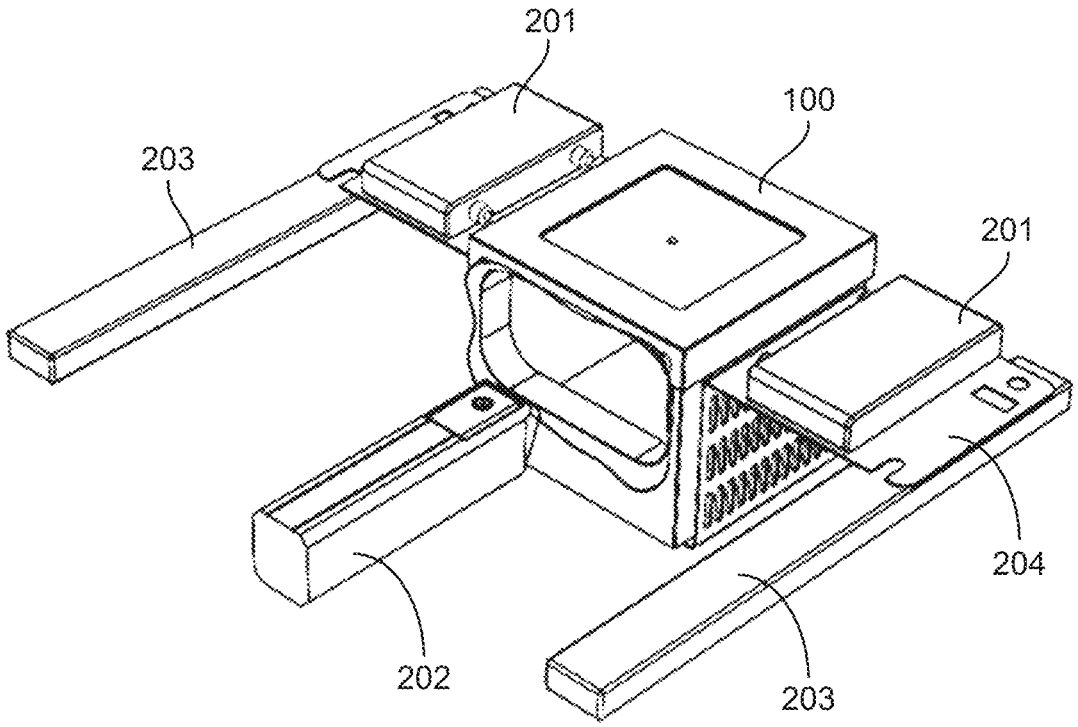

To embroider articles retained in packaging, for example packaging 100 as shown in FIGS. 1A-H and 2A-2H, the packaging 100 may be automatically, for example by robotic arm(s), or manually, for example by a person, positioned within between grippers 201 of an embroidery machine 200, for example as shown in FIG. 21. The grippers 201, attached to feeders 203 of the embroidery machine 200 with brackets 204 as shown in FIG. 2I, may be received in the recesses 117, which may be included on one or more of the top box portion 101, internal box portion 110 or the bottom box portion 102. The embroidery machine 200 may manipulate the packaging 100, and therefore the article 106, while accessing the interior surface of the portion 112 of the article 106 held taut within the packaging 100 with the cylinder bed 202, as shown in FIG. 2I.

FIGS. 3A-3M show an example set of steps for clamping the portion of the article 106 to be embroidered between a top box portion and another component of a packaging as disclosed herein, pre-wrapping a remaining portion of the article into a bag which may be placed into an internal cavity of the packaging, and positioning another portion of the article so that the taut portion can be accessed by the embroidery machine. In some embodiments, once assembled in the embroidering configuration, a robot, cobot or similar automation system, may retrieve the packaging and article from a storage location, for example but not limited to: a store shelf, a vending machine, or a kiosk storage area. A pneumatic or electromagnetic gripper may be used to hold the combination of the packaging, or portion thereof, and article in place and secured during the loading and unloading of the combination of the packaging, or portion thereof, and article before and after embroidering by the embroidery machine. In some embodiments, using a robot, cobot, or similar automation system, eliminates the requirement of a human operator to load the article onto the embroidery machine, and to unload the finished embroidered article from the embroidery machinery when operations are executed. Additionally, once the embroidery process is completed, the packaging design may be configured to be converted into a finished protective package, for example a gift box, for the consumer to carry out of the place of acquisition. Additionally, the packaging allows articles to be preconfigured for embroidery, at a location other than the place of embroidery, which may reduce production errors emerging from mistakes during the setup of an article for embroidery, thus improving production quality and increasing production output.

Figure 3A:
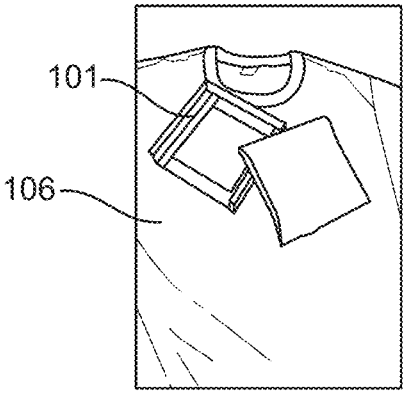
FIGS. 3A-3M show steps of attaching an article to packaging according to embodiments of the present technology.
Figure 3B:
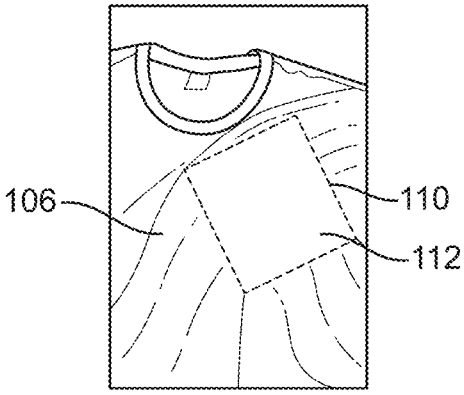
Figure 3C:
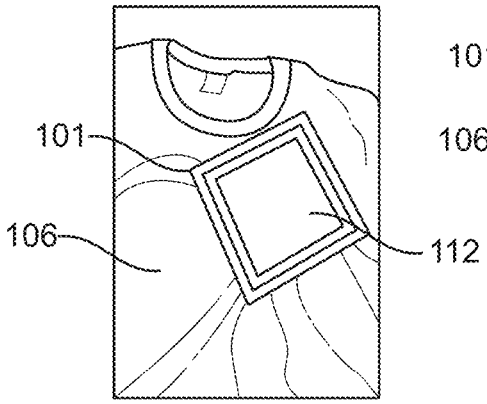

FIG. 3A shows an example of a first step of folding and orienting the article 106 to be embroidered. As shown in the example of FIG. 3A, a T-shirt to be personalized with a logo or embroidered pattern sewn into the upper left chest area is positioned relative to a top box portion 101. As shown in FIG. 3B, the internal box portion 110 is placed within the article 106, and aligned under the portion 112 to be embroidered, in this case the upper left chest area of the T-shirt. Stabilizer material may be placed between the second support bracket and the article 106. Next, in the example shown, the top box portion 101 is placed over the portion 112 and coupled to the internal box portion 110, resulting in the portion 112 to be embroidered being held taut in the window 105, as shown in FIG. 3C. The steps disclosed herein may be performed manually or automatically. In some embodiments, the top box portion 101 may be coupled to the internal box portion 110, or other packaging portion, in order to clamp the portion 112 using magnetic coupling and/or a press-fit. For example a window flange 121 of a top box portion 101 or another component, may be press fit into the internal window 119, with the article 106 there between. In some embodiments, with the portion 112 clamped taut in the window 105, the article 106 may be embroidered without attaching other portions of the packaging to the assembly of the upper box portion 101, the internal box portion 110, and the article 106. For example, the article 106 may be embroidered while clamped to the upper box portion 101 without the lower box portion 102 coupled to any components of the packaging. In some such embodiments, the lower box portion 102 may be attached after embroidering in order to place the packaging in a retail configuration. In some embodiments, the top box portion 101 used during embroidery may be uncoupled from the internal box portion and/or the lower box portion, and may be replaced with a different top box portion.

Figure 3D:
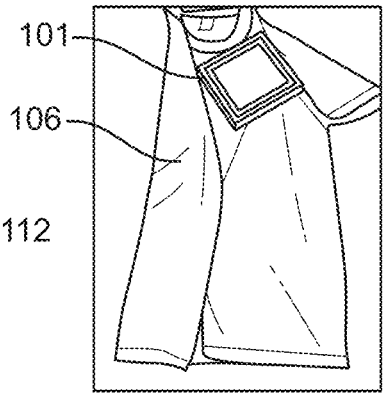
Figure 3E:
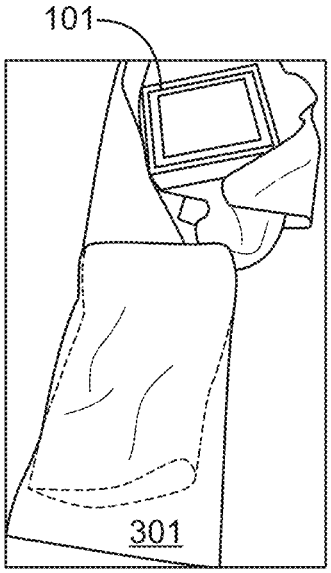
Figure 3F:
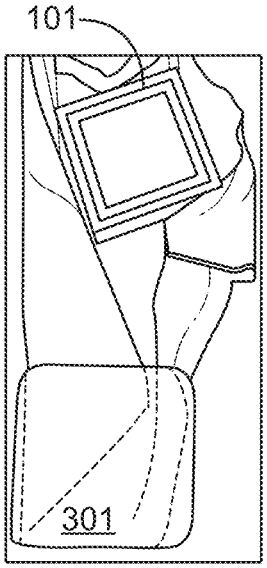
Figure 3G:
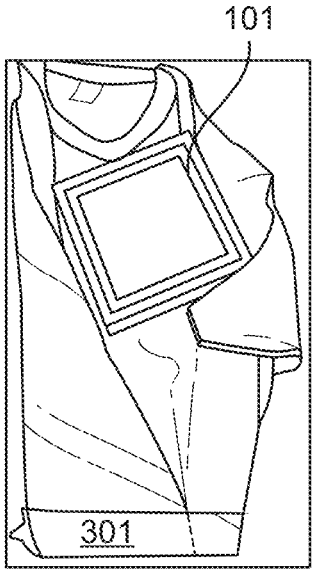
Figure 3H:
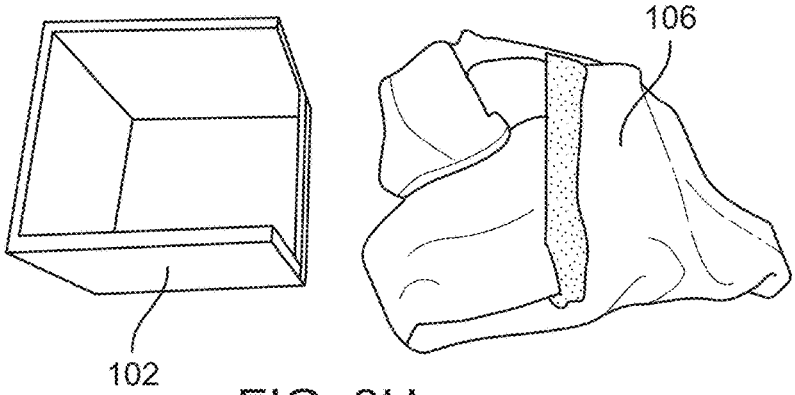
Figure 3I:
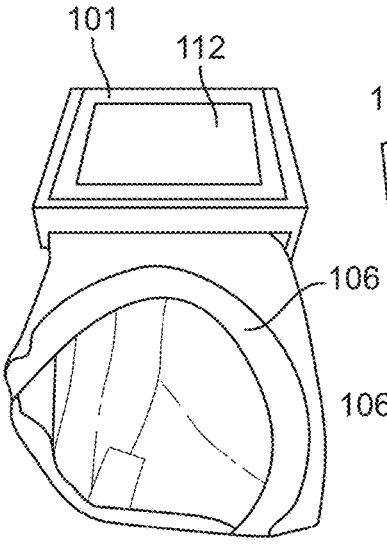
Figure 3J:
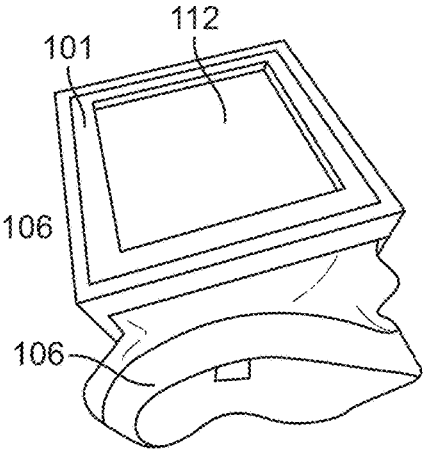
Figure 3K:
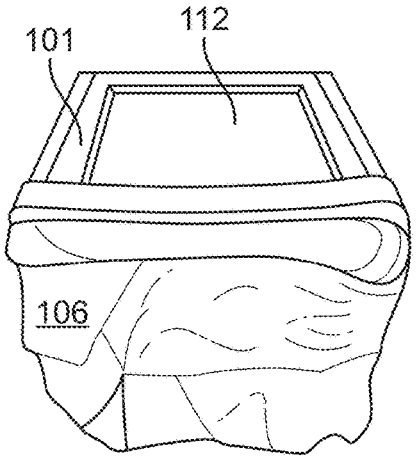
Figure 3L:
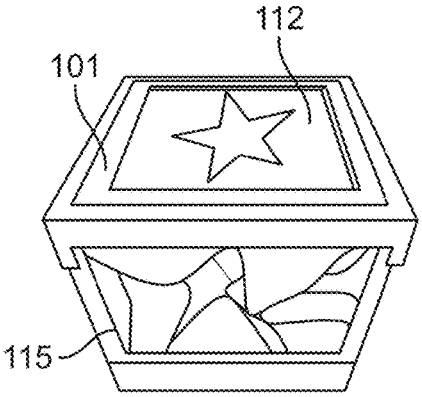
Figure 3M:
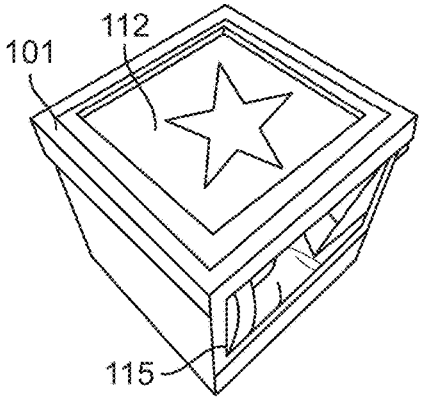

In some embodiments, after the step shown in FIG. 3C, the portions of the article 106 not clamped between the top box portion and the internal box portion may be folded as shown in FIG. 3D, in order to be placed inside of a bag 301, as shown in FIGS. 3E-G. The folded and bagged article 106 may then be placed in an internal cavity of the packaging, for example inside of a bottom box portion 102 as shown in FIGS. 3H-J. In some embodiments, with the packaging 100 assembled to include the top box portion 101 and the bottom box portion 102, and the article 106 within the packaging, the article 106 may be further positioned within the interior cavity of the packaging in order to provide access to the portion of the article to be embroidered by the embroidery machine. For example, as shown in FIG. 3K, the neck hole of the T-shirt is pulled through the embroidering access opening and folded over a portion of the exterior of the packaging in order to place the packaging and article in the embroidering configuration. Once embroidered, the article 106 may be positioned entirely within the packaging 100 in a retail configuration as shown for example in FIGS. 3L and 3M.

While the above examples pertained to embroidering an article, the same packaging and methods may be used to customize an article with other techniques, such as, but not limited to a combination of one or more of Direct-to-Garment (DTG) printing, dye sublimation, heat transfer printing processes, acid washing, and laser etching. In some embodiments, the packaging may include markings or physical features to be used for alignment by the embroidery machine. In some embodiments, the packaging may include a label, for example a sticker, used for alignment, inventory control, and/or in-store security, for example a barcode and/or a Radio Frequency Identification (rfid) tag.

The invention has now been described in detail for the purposes of clarity and understanding. However, those skilled in the art will appreciate that certain changes and modifications may be practiced within the scope of the appended claims.

What is claimed is:

1. A packaging for retaining an article to be embroidered, the packaging comprising:

a top box portion comprising a top side defining a window;

a first support bracket coupled to the top side, wherein the first support bracket defines a bracket window corresponding in shape and size to the window of the top side; and an internal box portion configured to couple to the top box portion in order to retain a portion of the article to be embroidered taut across the window at least during an embroidering process;

wherein the top box portion, and the internal box portion define an interior cavity of the packaging, and wherein at least one of the top box portion or the internal box portion defines an embroidering access opening configured to provide an embroidery machine access to the interior cavity and the portion of the article to be embroidered with an embroidery design.

2. The packaging of claim 1, wherein the first support bracket includes at least one metallic material portion that is magnetic, diamagnetic, ferromagnetic or paramagnetic, and wherein the first support bracket is magnetically coupled to the internal box portion to sandwich the portion of the article thereby retaining the portion of the article to be embroidered taut across the window at least during an embroidering process.

3. The packaging of claim 1, wherein the internal box portion comprises a second support bracket having a similar shape and size as the first support bracket.

4. The packaging of claim 1, wherein the article is placed against the first support bracket with the portion of the article to be embroidered positioned and aligned within the window of the top box portion.

5. The packaging of claim 1, further comprising:

a bottom box portion that couples to the top box portion to define a box, wherein one or more sidewalls of the top box portion are positioned outside of one or more sidewalls of the bottom box portion, or wherein one or more sidewalls of the bottom box portion are positioned outside of one or more sidewalls of the top box portion.

6. The packaging of claim 5, wherein while the portion of the article to be embroidered is held taut between the first support bracket and the internal box portion, remaining portions of the article are placed in the bottom box portion, and enclosed in the box formed by the top box portion and the bottom box portion.

7. The packaging of claim 1, wherein an outline of the first support bracket substantially corresponds to a shape and size of an outline of the top side.

8. The packaging of claim 1, wherein the first support bracket is coupled to the top side via a double-sided tape.

9. The packaging of claim 1, wherein the top box portion and the internal box portion are configured to frictionally engage each other to hold the portion of the article in the window.

10. The packaging of claim 1, wherein the article comprises one or more alignment marks for positioning the article within the window.

11. The packaging of claim 1, wherein the first support bracket or the internal box portion comprises a stabilizer material positioned between the article and a surface of the first support bracket or the internal box portion, wherein the stabilizer material is a backing that is coupled to the article along with the embroidery design.

12. The packaging of claim 1, wherein the top box portion includes one or more recesses on one or more side surfaces, wherein the one or more recesses are configured to couple to one or more grippers of the embroidery machine.

13. The packaging of claim 1, wherein a surface of the first support bracket and a surface of the internal box portion are substantially parallel to the portion of the article to be embroidered.

14. The packaging of claim 1, wherein a surface of the first support bracket comprises one or more sloped conical surface features that complement one or more sloped conical surface features provided on a surface of the internal box portion.

15. A system comprising an embroidery machine and the packaging of claim 1 positioned between a plurality of grippers of the embroidery machine such that the plurality of grippers are received in a plurality of recesses formed on the top box portion of the packaging.

16. A packaging for retaining an article to be customized, the packaging comprising:

a top box portion comprising a top side defining a window;

a first support bracket coupled to the top side, wherein the first support bracket defines a bracket window corresponding in shape and size to the window of the top side; and an internal box portion configured to couple to the top box portion in order to retain a portion of the article to be customized taut across the window at least during a customization process;

wherein the top box portion, and the internal box portion define an interior cavity of the packaging, and wherein at least one of the top box portion, or the internal box portion define a customization access opening configured to provide a customization machine access to the interior cavity and the portion of the article to be customized with a customization design.

17. The packaging of claim 16, wherein the customization machine is one or more of an embroidery machine, a direct-to-garment (DTG) printing machine, a dye sublimation system, a heat transfer printing system, an acid washing system or a laser etching system.

18. The packaging of claim 16, wherein the first support bracket includes at least one metallic material portion that is magnetic, diamagnetic, ferromagnetic or paramagnetic, and wherein the first support bracket is magnetically coupled to the internal box portion to sandwich the portion of the article thereby retaining the portion of the article to be customized taut across the window at least during a customization process.

19. The packaging of claim 16, further comprising:

a bottom box portion that couples to the top box portion to define a box, wherein one or more sidewalls of the top box portion are positioned outside of one or more sidewalls of the bottom box portion, or wherein one or more sidewalls of the bottom box portion are positioned outside of one or more sidewalls of the top box portion.

20. The packaging of claim 19, wherein while the portion of the article to be embroidered is held taut between the first support bracket and the internal box portion, remaining portions of the article are placed in the bottom box portion, and enclosed in the box formed by the top box portion and the bottom box portion.

* * * * *